US005153959A

United States Patent [19]

Fitzsimmons

[11] Patent Number: 5,153,959

[45] Date of Patent: Oct. 13, 1992

[54] METHOD AND APPARATUS FOR PATIENT ASSISTED MOVEMENT IN CONVALESCING BED

[76] Inventor: John H. Fitzsimmons, 5571 Maxwelton, Oakland, Calif. 94618

[21] Appl. No.: 852,465

[22] Filed: Mar. 17, 1992

[51] Int. Cl.[5] ..... A61G 7/10; A61G 7/00

[52] U.S. Cl. ..... 5/662; 5/81.1; 482/91; 482/130; 482/904

[58] Field of Search ..... 5/662, 624, 658, 503.1, 5/81.1; 482/904, 91, 130

[56] References Cited

U.S. PATENT DOCUMENTS

| | | | |
|---|---|---|---|
| 1,047,231 | 12/1912 | Ingman | 5/662 |
| 3,523,310 | 8/1970 | Shead | 482/904 |
| 4,765,005 | 8/1988 | Hippel | 5/662 |

FOREIGN PATENT DOCUMENTS

| | | | |
|---|---|---|---|
| 336807 | 6/1904 | France | 5/662 |

*Primary Examiner*—Alexander Grosz
*Attorney, Agent, or Firm*—Townsend and Townsend

[57] ABSTRACT

An apparatus and process for the movement of a patient within a hospital bed is disclosed. A strap is utilized in the process having a first portion for fastening to the head of the bed and a second portion for defining a foot hold for the patient. Preferably, the first portion of the strap is designed to slip over the upper edge of the hospital bed mattress, preferably at a corner of the mattress. The strap is thereafter laid over the surface of the hospital bed mattress to the vicinity of one foot of the patient. The strap in the fully tensioned position includes the placement of the patient foot hold at a location where the foot of the patient can be placed to the foot hold portion of the strap with the knee and thigh flexed. Thereafter, only sufficient hospital personnel are utilized to lift the patient with limited but sufficient force to lift the patient's thoracic and lumbar spine from the mattress to reduce the static coefficient of friction between the bedding and the patient. At the same time, the patient "steps down into" the foot hold of the strap with the natural motion of extending the knee and hip, exerting a tensile force from the strap to and toward the head of the bed.

5 Claims, 1 Drawing Sheet

METHOD AND APPARATUS FOR PATIENT ASSISTED MOVEMENT IN CONVALESCING BED

This invention relates to an apparatus and process to enable a patient to assist hospital personnel in necessary vertical movement of the patient from the base of the bed to the head of the bed. Specifically, the apparatus includes a strap that is preferably draped over an upper corner of the bed and provided with a foot step at the lower portion. During the process of movement, the patient inserts his foot to the strap at the foot hold portion. By extending the knee and hip, the patient exerts a force toward the head of the bed while being provided with only necessary assistance from hospital personnel. Patient movement occurs with increased patient confidence, patient cooperation, and the reduction of the risk of back injury to hospital personnel.

BACKGROUND OF THE INVENTION

The movement of a hospital patient in bed constitutes a serious source of back extension injury to hospital personnel. A review of conventional movement of patients in hospital beds is useful in the understanding of this phenomena.

Hospital beds often require the necessary relative elevation of the head of the bed for sitting up, eating, drinking, visiting, being examined and medical circumstance. During such movements—accommodated largely by the articulation of the hospital bed and the responsive movement of the patient—it is common for the patient to slip relative to the bed. Such slipping motion is almost always from the head of the bed to and towards the foot of the bed. As a result it is required that the patient be restored to the center of the bed. Unfortunately, this a restoration is not independently accomplished by the patient without difficulty.

Presuming that a patient has slipped downward in a hospital bed, and must be repositioned upwardly to and toward the head of the bed, conventional hospital practice requires that this be done manually—without the assistance of the patient. Specifically, groups of hospital personnel gather on the sides of the hospital bed. Thereafter, the patient is lifted—and moved forward in the bed. This transfer is a common source of back injury to hospital personnel.

First, and with regard to the necessity of the hospital personnel to lift the patient, the hospital personnel are immediately adjacent the side of the hospital bed. It is required that the personnel bend at the waist and lean out over the bed. In this position, the muscles of the back can be completely lengthened. In this lengthened position, the muscles are in the weakest and most exposed disposition to possible injury. All strain of lifting is borne by the back in the least favorable position for lifting. In cases where the back is strained beyond its limit, injury such as tearing of the muscles and ligaments can easily occur. Proper training in lifting can minimize the risk of injury, but the nature of this patient transfer places the attendant at increased risk.

Secondly, and when the hospital personnel are in this extended position, in order to move the patient to the head of the bed, the hospital personnel must extend and rotate at the waist—all at a time when their backs are extended and unduly exposed to injury. Indeed, it is during this rotational movement of the extended back that injury most frequently occurs because of increased forces generated in a combined movement.

Finally, this whole process is not particularly comforting to the patient. The patient is "dead weight" during the movement. He has no sense of cooperation—and no sense of security that can come from such cooperation.

SUMMARY OF THE INVENTION

An apparatus and process for the movement of a patient within a hospital bed is disclosed. A strap is utilized in the process having a first portion for fastening to the head of the bed and a second portion for defining a foot hold for the patient. Preferably, the first portion of the strap is designed to slip over the upper leading edge of the hospital bed mattress, preferably at a corner of the mattress. The strap is thereafter laid over the surface of the hospital bed mattress to the vicinity of one foot of the patient. The strap in the fully tensioned position includes the placement of the patient foot hold at a location where the foot of the patient can be placed to the foot hold portion of the strap with the knee and hip flexed. Thereafter, only sufficient hospital personnel are utilized to lift the patient with limited but sufficient force to lift the patient's thoracic and lumbar spine from the mattress to reduce the static coefficient of friction between the bedding and the patient. At the same time, the patient "steps down into" the foot hold of the strap with the natural motion of straightening the knee and hip, exerting a tensile force from the strap to and toward the head of the bed. There results patient movement towards the head of the bed which no longer requires twisting of the extended and exposed backs of the hospital personnel and permits the patient to naturally participate in the bed movement realizing the security that comes from cooperation in natural body movement. Additionally, if movement is not desired, and friction is not reduced by attendants, the tensile force of extending the hip and knee can generate sufficient resistance to exert an isometric contraction of the leg musculature. This force can approximate a partial gravitational loan on the musculoskeletal system with the patient in a non-weight bearing position.

DESCRIPTION OF THE PREFERRED EMBODIMENT

Figure 1:
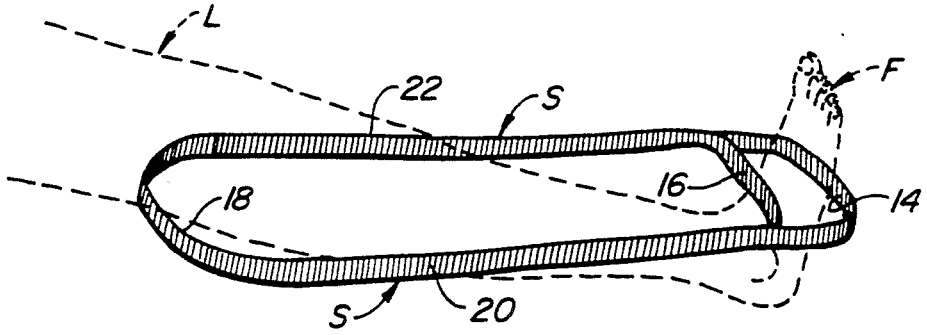
FIG. 1 is a view of a loop type strap including an upper portion for fitting over the head of a hospital bed, preferably at a mattress corner, and defining at the lower portion two separate foot holds—these respective foot holds being for patients of differing sizes.

Referring to FIG. 1, the strap of this invention is illustrated in a preferred embodiment. The strap S includes first foot loop 14, second foot loop 16 and is configured in an endless loop format. Accordingly, strap S includes sides 20, 22 with an end 18 for fastening to the end of the bed B (See FIG. 2).

As will be apparent, only two things are required of strap S. First, strap S must provide for the patient a foot hold. Second, strap S should be able to fasten to some portion of the head of the bed, mattress, or other fix point from which tension can be taken to support the desired movement of the patient P. Thus, it is not required that the strap be constructed as a loop.

Figure 2:
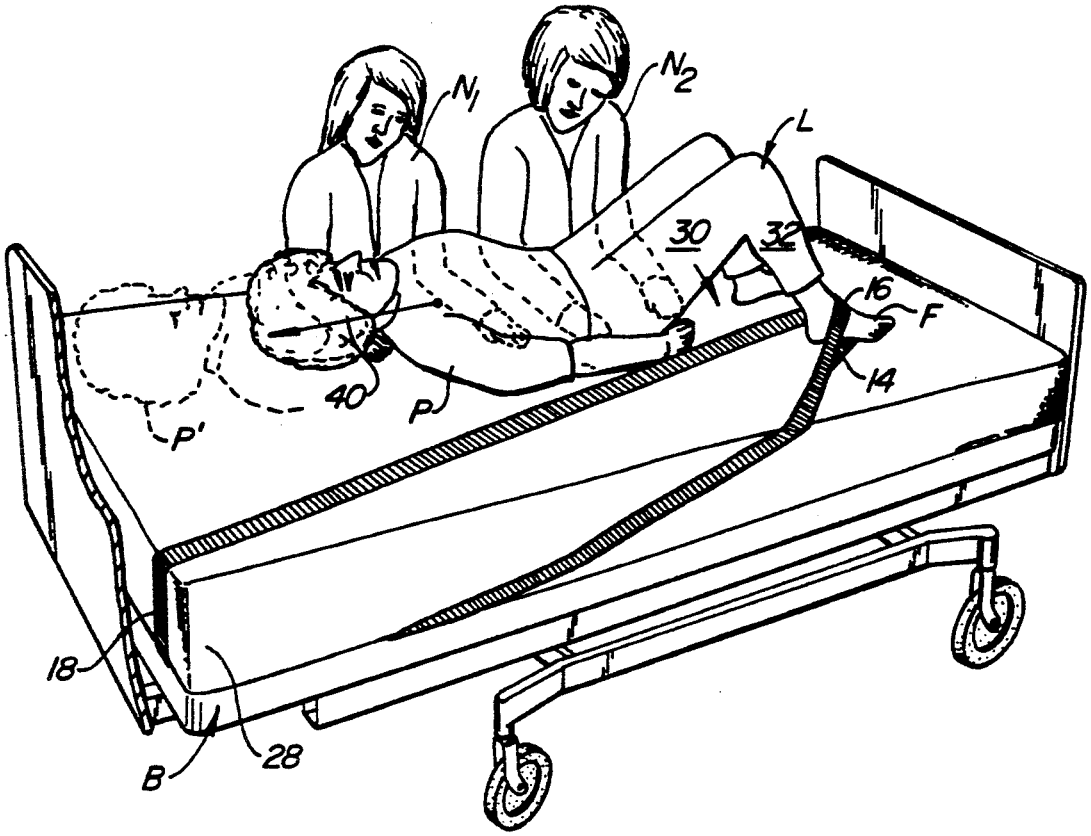
FIG. 2 is a perspective view showing a patient slipped towards the foot of the bed, the strap over the head of the bed at the corner of the mattress, the foot hold portion of the strap adjacent the foot of a patient with the knee and hip of the patient in the flexed position, and hospital personnel shown at one side of the hospital bed only for supplying a lifting force sufficient for reducing the static coefficient of friction between the patient and the bedding with the view in broken lines illustrating the patient immediately after extending the foot by straightening the knee and hip with the result that the patient has moved upwardly to and toward the head of the hospital bed.

Referring to FIG. 2, the apparatus and process of this invention can be understood. Patient P is shown in hospital bed B, the bed here being illustrated absent the considerable mechanical detail that provide for bed articulation with accompanying patient movement. Patient P is instead shown slipped to and toward the foot of the bed. For convenience of understanding patient P is shown with covers completely removed (although this is not required) with the sole of foot F being fitted to loop 14 (See broken line illustration FIG. 1). At mattress M at upper corner 28 strap S at loop 18 has been placed or "slipped" over the corner of the mattress.

Before any movement can occur, at least some of the weight of patient P must be lifted from bed B. Accordingly, nursing personnel $N_1$ and $N_2$ are shown lifting patient P upwardly. Such lifting occurs only to the extent required to reduce friction between bed B at mattress M. At the same time, patient P is instructed to flatten thigh 30 and calf 32 through leg extension. There results a stepping motion support by tension in the strap S. Patient P thus exerts the primary force in movement parallel to vector 40 moving the patient to and toward the head of bed B.

It will be understood that patient P thus becomes an active participant in bed movement, lessening the strain on the hospital personnel $N_1$ and $N_2$ and considerably adding to patient security.

It should be understood that the example given herein is exemplary. Obviously the bed may be in an articulated disposition when such movement is undertaken. For example, the foot of the bed B may be elevated with respect to the head of the bed B. Likewise, it will be appreciated that this invention will admit of considerable variation.

What is claimed is:

1. A process of moving a patient in a hospital bed to and toward the head of said hospital bed comprising the steps of:

providing a tensile member having two ends;

providing to said first end of said tensile member means for fastening said tensile member adjacent the head of said hospital bed;

providing to said second end of said tensile member means for defining at least one foot hold for placement of said foot of said patient to said foot hold;

fastening said first end of said tensile member to said bed adjacent the head of said bed;

positioning said second end of said tensile member at said foot hold adjacent said leg of said patient;

disposing said tensile member linearly between said two respective ends to provide immediate tensile force through said tensile member from said foothold to said bed;

placing the foot of said patient in said foot hold with the knee and hip of said patient flexed;

lifting said patient from the bedding over said mattress with sufficient force to cause reduction of the static coefficient of friction between said patient and said bedding; and, having said patient extend said leg at said flexed knee and hip into said foot hold at the second end of said tensile member to bring said tensile member under tension and to cause said patient to be moved toward the head of said bed from said foothold of said tensile member.

2. The process of claim 1 and wherein:

said tensile member is provided with a plurality of footholds.

3. The process of claim 1 and wherein:

fastening the first end of said tensile member includes looping said tensile member over an upper corner of a mattress of a hospital bed.

4. A process of moving a patient in a hospital bed to and toward the head of said hospital bed comprising the steps of:

providing a tensile member having two ends;

providing to said first end of said tensile member means for fastening said tensile member adjacent the head of said hospital bed;

providing to said second end of said tensile member means for defining at least one foot hold, comprised of a loop, for placement of said foot of said patient to said foot hold;

fastening said first end of said tensile member to said bed adjacent the head of said bed;

positioning said second end of said tensile member at said foot hold adjacent said leg of said patient;

disposing said tensile member linearly between said two respective ends to provide immediate tensile force through said tensile member from said foothold to said bed;

placing the foot of said patient in said foot hold with the knee and hip of said patient flexed; and, having said patient extend said leg at said flexed knee and hip into said foot hold at the second end of said tensile member to bring said tensile member under tension and to cause said patient's leg to be exercised.

5. The process of claim 4 and wherein:

said tensile member is elastic.

* * * * *